United States Patent [19]

Rogers et al.

[11] Patent Number: 5,075,521

[45] Date of Patent: Dec. 24, 1991

[54] INTERRUPTER SWITCH WITH COORDINATION OF DISCONNECT AND INTERRUPTER LINKAGE

[75] Inventors: Edward J. Rogers, Chicago; Thomas O. Fanta, Melrose Park; John Urbanek, Evanston, all of Ill.

[73] Assignee: S&C Electric Company, Chicago, Ill.

[21] Appl. No.: 591,187

[22] Filed: Oct. 1, 1990

Related U.S. Application Data

[63] Continuation-in-part of Ser. No. 331,216, Mar. 30, 1989, Pat. No. 4,983,792, and a continuation-in-part of Ser. No. 487,356, Mar. 1, 1990.

[51] Int. Cl.[5] ..... H01H 33/42; H01H 33/70

[52] U.S. Cl. ..... 200/148 F; 200/144 R; 200/145

[58] Field of Search ..... 200/148 F, 148 R, 144 R, 200/144 C, 48 A, 145, 568

[56] References Cited

U.S. PATENT DOCUMENTS

Re. 27,625 4/1973 Weston ..... 200/145

2,658,976 11/1953 Hoye ..... 200/145

*Primary Examiner*—Harold Broome

*Attorney, Agent, or Firm*—James V. Lapacek

[57] ABSTRACT

An arrangement is provided that includes a coordinating input for a mechanism of an interrupter switch; the coordinating input being derived from sensed movement of an element away from a first position and toward a second position. The coordinating input is utilized to trip the interrupters if they are closed. In a specific arrangement, a stored-energy mechanism is tripped to provide opening and closing of the interrupters via a high-speed interrupter drive train. The tripping arrangement is operable via a first input to cause movement of a latch member to release the stored-energy mechanism to operate the interrupter drive train. The first input may be actuated via open or close instructions, including both local and remote capabilities. The latch for the stored-energy mechanism is reset after each actuation. An output shaft of the mechanism is connected to drive the interrupter drive train. Both opening and closing are accomplished via rotation of the output shaft in the same direction. An open/close sensing input for the interrupter drive train is derived from the position of the output shaft. In a specific embodiment, the sensed movement of the element corresponds to the movement of a disconnect linkage away from a closed position. The input from the disconnect linkage is utilized to release the latch member only if the open/close sensing input is in the closed position.

12 Claims, 3 Drawing Sheets

INTERRUPTER SWITCH WITH COORDINATION OF DISCONNECT AND INTERRUPTER LINKAGE

CROSS-REFERENCE TO RELATED APPLICATIONS

This application is a continuation-in-part application of U.S. application Ser. Nos. 07/331,216 filed U.S. Pat. No. 4,983,492 in the names of E. Rogers et al on Mar. 30, 1989 and 07/487,356 filed in the names of J. Ramos et al on Mar. 1, 1990.

BACKGROUND OF THE INVENTION

1. Field of the Invention

The present invention relates generally to the field of electrical switches and circuit interrupters, and more particularly to an arrangement for coordinating the operation and positions of a disconnect linkage and an interrupter drive train.

2. Description of the Related Art

Various arrangements are known in the electrical power transmission and distribution fields for providing a circuit-interrupting function and visible air-gap isolation via a disconnect. For example, see U.S. Pat. Nos. 2,658,976, Re. 27,625 and 4,677,262. Additionally, co-pending U.S. applications Ser. Nos. 07/331,216 (now U.S. Pat. No. 4,983,792) and 07/487,356, assigned to the assignee of the present invention, are directed to an interrupter switch with selective disconnect. In such arrangements, the interrupter is rated to interrupt the load current whereas the disconnect is not. Thus, the interrupter must be operated to interrupt the current before the disconnect is opened.

The foregoing arrangements coordinate operation of the interrupter function and the disconnect function in various ways. For example, the arrangement of U.S. Pat. Nos. Re. 27,625 and 2,658,976 utilize an operating mechanism which provides for initial operation of the interruption function with continued operation causing disconnect operation. Closing operating of the disconnect also must take place before continued operation can cause the interrupter function. In U.S. Pat. No. 4,677,262, a common drive is provided for operation of a disconnect and the charging of the operator mechanism for the interrupter. Upon tripping operation, the interrupter is opened followed by operation of the disconnect. With the disconnect open, closing of the interrupter is prevented via a sensor switch activated by the charging cam for the operator which is also on the same shaft as the disconnect device.

In the arrangement of U.S. application Ser. Nos. 07/331,216 (now U.S. Pat. No. 4,983,792) and 07/487,356, a manually operable disconnect is provided. Additionally, locally and remotely controlled opening and closing operation of the interrupt function is provided. Thus, the need arises for coordination since the interruption and disconnection functions are not under the control of a common sequencing operation and can be individually controlled or actuated. As disclosed in the aforementioned '216 application, coordination for appropriate sequencing can be provided via mechanical and/or electrical arrangements. Specifically, a link 155 or a switch 150 can be utilized to sense initial operation of the manual disconnect out of the closed position, thus causing the operation of the interrupter to an open position prior to opening of the disconnect contacts. Additionally, another switch senses the open position of the disconnect and provides information to electrically inhibit the operator from closing the interrupters. The invention of the present application is directed to improvements of the arrangements of the aforementioned '216 application.

U.S. Pat. No. 3,894,245 is directed to a stored-energy operator for a switch and includes a latch arrangement for releasing an operating shaft.

SUMMARY OF THE INVENTION

Accordingly, it is a principal object of the present invention to provide coordination of an interrupter drive train with an independently operable disconnect linkage of a switch such that operation of the disconnect out of the closed position causes tripping of the interrupters; the coordination being accomplished by mechanically tripping a latch in the operating mechanism for the interrupter drive train when the interrupters are in a closed position and the disconnect linkage moves out of the closed position.

It is another object of the present invention to provide an input to a mechanism for an interrupter switch that represents movement of a disconnect feature such that the input is effective to cause tripping of the mechanism to open the interrupters if the interrupters are in the closed position.

These and other objects of the present invention are efficiently achieved by an arrangement for providing a coordinating input to a mechanism for an interrupter switch; the coordinating input being derived from sensed movement of an element away from a first position and toward a second position. The coordinating input is utilized to trip the interrupters if they are closed. In a specific arrangement, a stored-energy mechanism is tripped to provide opening and closing of the interrupters via a high-speed interrupter drive train. The tripping arrangement is operable via a first input to cause movement of a latch member to release the stored-energy mechanism to operate the interrupter drive train. The first input may be actuated via open or close instructions, including both local and remote capabilities. The latch for the stored-energy mechanism is reset after each actuation. An output shaft of the mechanism is connected to drive the interrupter drive train. Both opening and closing are accomplished via rotation of the output shaft in the same direction. An open/close sensing input for the interrupter drive train is derived from the position of the output shaft. In a specific embodiment, the sensed movement of the element corresponds to the movement of a disconnect linkage away from a closed position. The input from the disconnect linkage is utilized to release the latch member only if the open/close sensing input is in the closed position. Sensing of the position of the disconnect linkage is also utilized to provide an inhibit signal to the closing control arrangement to prevent closing of the interrupters when the disconnect is open.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
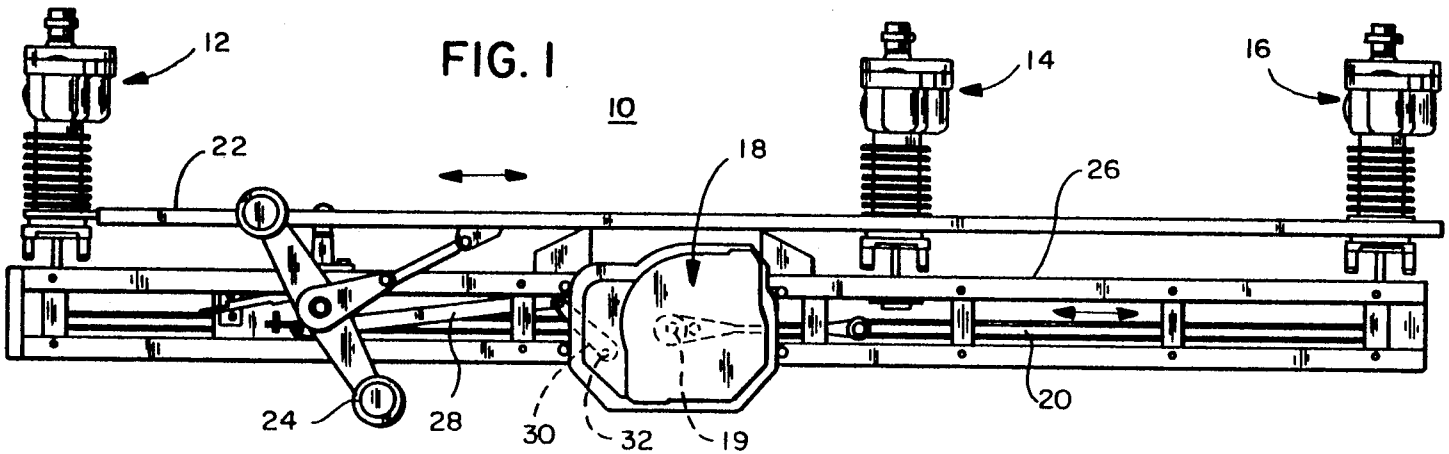
FIG. 1 is an elevational view of a switch utilizing the coordination arrangement of the present invention.

Referring to FIG. 1, an interrupter switch 10 is illustrated that utilizes the coordination arrangement of the present invention. The interrupterswitch 10 includes a plurality of switch-pole units 12, 14 and 16. An operating mechanism 18 via a drive output at output shaft 19 operates an interrupter drive train generally referred to at 20. The interrupter drive train 20 is a high-speed drive train or linkage that is coupled to operate an interrupter function of each of the switch-pole units 12, 14 and 16 between open and closed positions. Each of the switch-pole units 12, 14 and 16 is also operable to perform a disconnect function via a disconnect linkage 22 to provide a visible air gap. The disconnect linkage 22 is operable via a manual crank arm 24; i.e., by way of a suitable insulated hookstick or the like. Operation of the crank arm 24 provides opening and closing of the disconnect feature via movement of the switch-pole units 12, 14 and 16. The switch-pole units 12, 14 and 16 are rotatably mounted with respect to a support base 26 which also supports the operating mechanism 18.

A disconnect-position sensing arrangement including link members 28,30 provide an input to the operating mechanism 18 that represents the position of the disconnect linkage 22. This input also represents the status of the disconnect feature of the switch-pole units 12, 14 and 16 and provides a mechanical displacement input corresponding to movement of the crank arm 24 out of the closed position toward the open position. As will be explained in more detail hereinafter, the operating mechanism 18 utilizes the input at a shaft 32 from the link members 28,30 to operate the interrupter drive train 20 to the open position if the drive output 19 indicates that the interrupters are closed when the crank arm 24 is moved away from the closed position and toward the open position. Alternatively, if the interrupters are already open when the crank arm 24 is moved away from the closed position and toward the open position, the operating mechanism 18 does not respond and does not operate the interrupter drive train 20.

Figure 2:
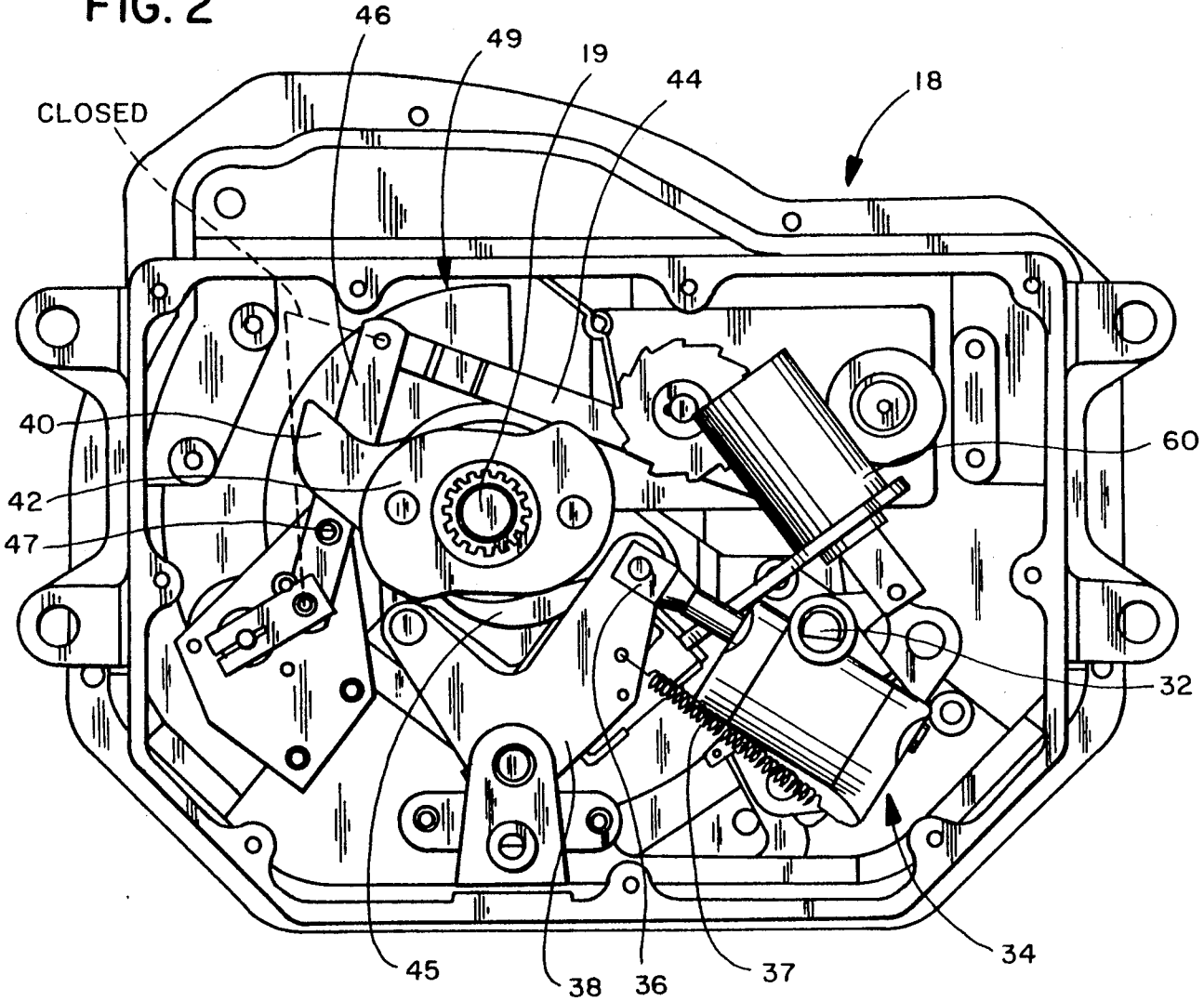
FIG. 2 is an elevational view with parts removed and cut away for clarity of the mechanism of FIG. 1 for controlling interrupter operation.

Considering now the detailed features of the operating mechanism 18 and referring additionally to FIG. 2, a latch arrangement 34 via drive rod 36 and a spring 37 controls the release of stored energy to rotate the output shaft 19. Specifically, the drive rod 36 and the spring 37 are actuable to withdraw a pawl member 38 from engagement with a latch member 40 affixed to the output shaft 19, thus permitting rotation of the output shaft 19. The latch member 40 also carries a resetting cam member 42 which is arranged to move the pawl member 38 and the drive rod 36 to a reset position, whereupon the latch arrangement 34 is latched until the next operation; the opposite end of the latch member 40 being engaged and held by the pawl member 38. The latch arrangement 34 receives the sensed disconnect input at the shaft 32 from the link members 28,30. Additionally, the latch arrangement 34 receives open/close information for the interrupter drive train 20 via two link members 44 and 46. The link member 46 is pivotally mounted at 47 and is engaged by a cam 45 that is fixed to the output shaft 19. Thus, the position of the link member 44 defines the open/close status of the mechanism 18 and the interrupter feature of the switch-pole units 12,14,16. The stored-energy arrangement, generally referred to at 49, is charged to store energy and is arranged to transmit motion to the output shaft 19 when the latch 40 is released.

Figure 4:
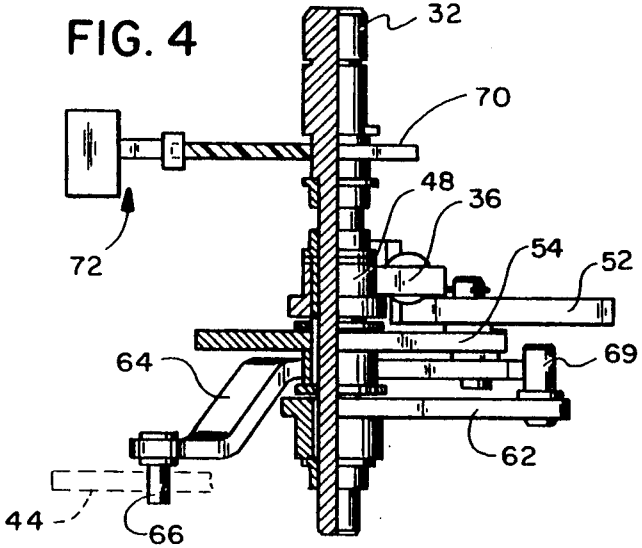
FIGS. 3 and 4 are respective front and bottom elevational views, partly in section, of a latch arrangement of the mechanism of FIG. 2 additionally including coordination arrangements and inputs of the present invention.
Figure 3:
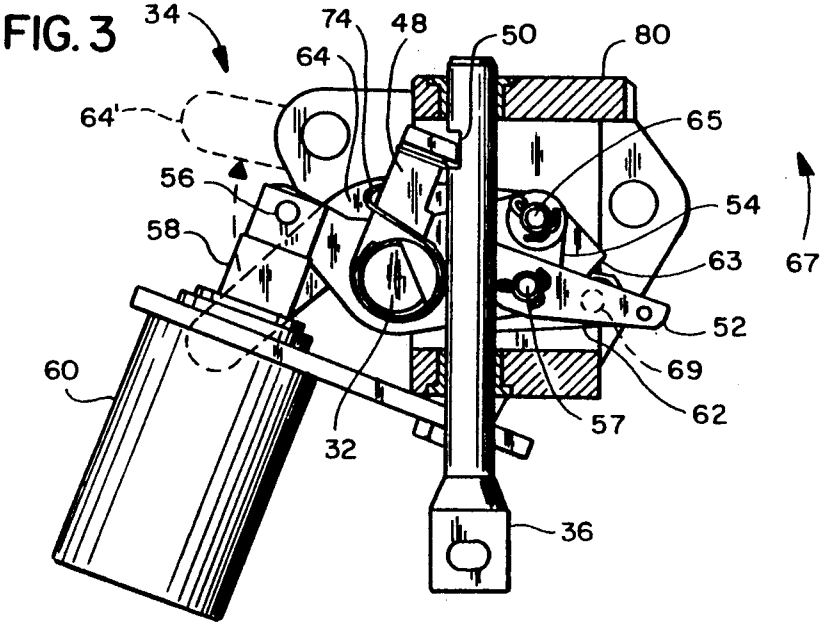
Figure 5:
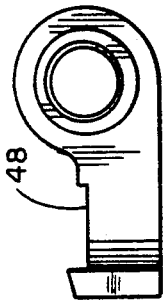
FIGS. 5-11 are views of respective operational elements of the latch arrangement of FIGS. 3 and 4, with FIG. 6 being a front view of FIG. 5, FIG. 9 being a front view of FIG. 8, and FIG. 11 being a top plan view of FIG. 10.
Figure 6:
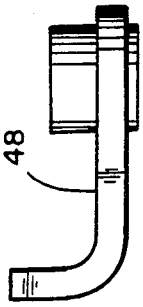
Figure 7:
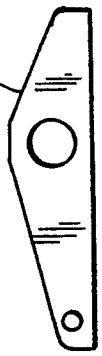
Figure 8:
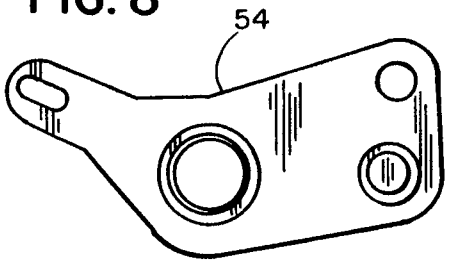
Figure 9:
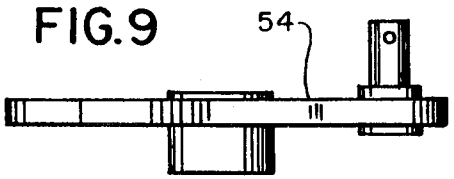

Referring now additionally to FIGS. 3 and 4, the latch arrangement 34 includes a trip lever 48 (also see FIGS. 5 and 6) rotatably carried about the shaft 32 and arranged to engage a slotted portion 50 of the drive rod 36. The trip lever 48 is rotated or pivoted to release the drive rod 36 via an intermediate actuator member 52 (also see FIG. 7) and a lever member 54 (also see FIGS. 8 and 9) that is rotatably carried about the shaft 32 and pivotally attached at 56 to the plunger 58 of a solenoid 60. The intermediate actuator member 52 is pivotally carried at 57 by the lever member 54.

Upon actuation of the solenoid 60, the plunger 58 pivots the lever 54 counterclockwise in FIG. 3 and the intermediate actuator member 52 so as to pivot the trip lever 48 counterclockwise which releases the drive pin 36 to move upward in FIG. 3. Thus, upon actuation of the solenoid 60, the pawl 38 under the bias of the spring 37 releases the latch 40 to permit a 180° rotation of the output shaft 19 to perform an opening or closing operation of the interrupter feature of the switch-pole units 12, 14 and 16 via the interrupter drive train 20.

Figure 11:
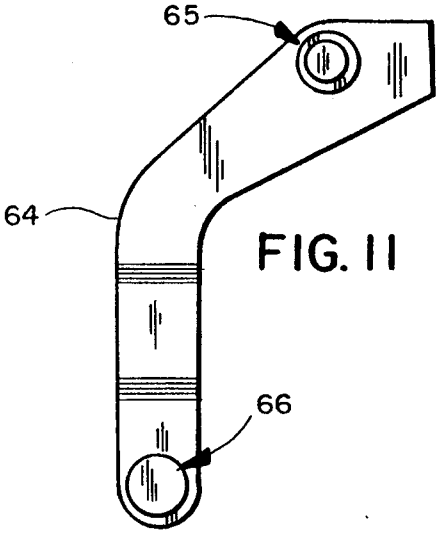
Figure 10:
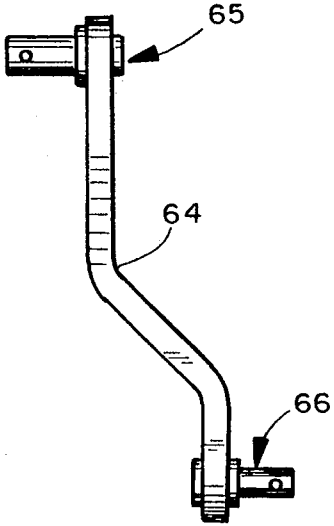

An auxiliary trip lever 64 (also see FIGS. 10 and 11) is pivotally carried at 65 by the lever member 54. The link member 44 is pivotally connected to the auxiliary trip lever 64 at 66. When the output shaft 19 is in the closed position corresponding to the configuration shown in FIGS. 3 and 4 (but open in FIG. 2), the auxiliary trip lever 64 is in the illustrated position. When the output shaft 19 is in the open position illu in FIG. 2, the auxiliary trip lever 64 is pivoted clockwise to a position illustrated in phantom at 64' in FIG. 3. The shaft 32 fixedly carries a disconnect-sensing lever 62. Rotation of the shaft 32 due to movement of the crank arm 24 causes rotation of the disconnect-sensing lever 62 in the direction 67. With the auxiliary trip lever 64 in the illustrated position (closed), the disconnect-sensing lever 62 via a projecting pin 69 engages the auxiliary trip lever 64 at 63, and pivots the auxiliary trip lever 64 which in turn imparts motion to the lever 54. As discussed hereinbefore, movement of the lever 54 results in the release of the drive pin 36 and rotation of the shaft 19 to operate the interrupter linkage 20 to open the interrupters.

On the other hand, if the interrupters are open, the auxiliary trip lever 64 would be in the open position shown in phantom at 64' in FIG. 3. In that event, upon operation of the crank arm 24 and movement of the disconnect-sensing lever 62, the lever 64 is not contacted and no tripping operation is provided.

The shaft 32 also fixedly carries a cam 70 which cooperates with a switch 72 to provide an input to inhibit tripping operation of the mechanism 18 in response to a close input signal when the disconnect crank arm 24 is out of the closed position.

Considering further details of the latch 34, the trip lever 48 is biased clockwise in FIG. 3 via a spring 74. The intermediate actuator member 52 is biased counterclockwise in FIG. 3 by a spring (not shown). Additionally, the lever member 54 is biased clockwise by a spring (not shown). A support bracket 80 slidably carries the drive pin 36 and rotatably supports the shaft 32.

Figure 12:
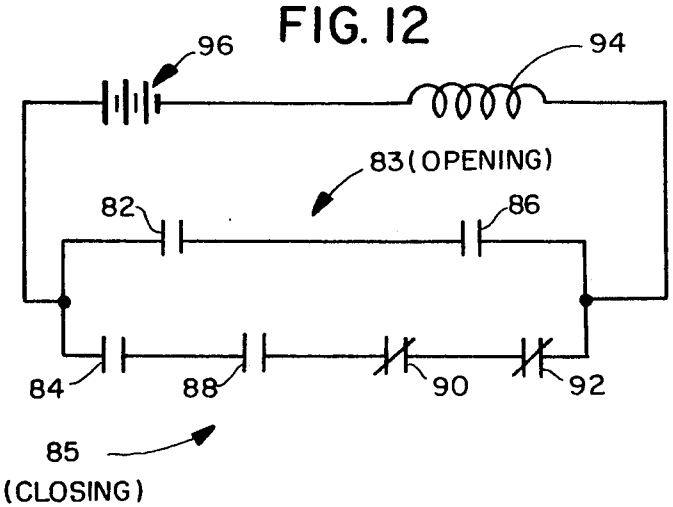
FIG. 12 is an electrical schematic representation illustrating the basic control circuit of the present invention.

Referring now additionally to FIG. 12, an illustrative control circuit is shown in schematic form to describe the basic elements for operation of the mechanism 18. The $R_o$ contact 82 and the $R_c$ contact 84 respectively represent open and close contacts made by respective open and close controls. In specific arrangements, the open and close controls include local operation via pushbuttons and remote operation via actuation signals. The open contact 82 is included in an open operation-control path 83 that is in series with an inhibiting contact 86. The contact 86 is arranged to be closed only when the interrupter drive train 20 via the output shaft 19 corresponds to the closed position. Thus, the contact 86 inhibits operation in response to an open signal if the interrupter drive train 20 is in the open position. In a close operation-control path 85, the close contact 84 is in series with three inhibiting contacts 88, 90 and 92. The inhibit contact 88 inhibits operation to close the interrupter feature if the disconnect is in the open position. The contact 88 corresponds to the switch 72 and is open any time the crank arm 24 is out of the closed position. The inhibit contact 90 serves to inhibit closing operation if the stored energy of the mechanism 18 is low; thus ensuring that a close operation cannot take place unless an opening operation is also assured. This ensures manual operation of the disconnect. The inhibit contact 92 inhibits a closing operation unless the output shaft 19 is in a position corresponding to the open position of the interrupter feature. The open control path 83 and the close control path 85 are connected in parallel with each other and in series with a battery supply 96 and a trip solenoid coil 94 of the solenoid 60.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. An electrical interrupter switch comprising:

means for interrupting a circuit path including interrupter drive means operable between open and closed positions;

disconnect drive means including a disconnect drive linkage operable between open and closed positions;

tripping means actuable to provide a tripping input;

stored-energy mechanism for driving the interrupter drive means in response to said tripping input;

first means movable in response to the position of interrupter drive means; and second means for providing an input corresponding to movement of said disconnect drive linkage away from said closed position toward said open position, said second means comprising means for cooperating with said first means so that said first and second means cooperate to actuate said tripping means only when said first means is in a first position corresponding to said closed position of the interrupter drive means.

2. The electrical interrupter switch of claim 1 wherein said second means comprises means for engaging and moving said first means.

3. The electrical interrupter switch of claim 1 wherein said first means comprises a first member being movable in correspondence to the position of the interrupter drive means.

4. The electrical interrupter switch of claim 3 wherein the second means comprises a second member movable in correspondence to the position of said disconnect drive linkage.

5. The electrical interrupter switch of claim 4 wherein said second member engages said first member when said disconnect drive linkage is moved out of said closed position and said first member is in said first position.

6. The electrical interrupter switch of claim 5 wherein said first member is not engaged by said second member when said first member is in a second position corresponding to an open position of the interrupter drive means.

7. The electrical interrupter switch of claim 6 wherein said second means further comprises a shaft that fixedly carries said second member, said shaft being movable in correspondence to the position of said disconnect drive linkage.

8. The electrical interrupter switch of claim 7 wherein said tripping means further comprises third means rotatably carried by said shaft, said third means being rotated to initiate said tripping input.

9. The electrical interrupter switch of claim 8 wherein said first member is arranged to impart motion to rotate said third means in response to engagement by said second member.

10. The electrical interrupter switch of claim 9 wherein said first member is pivotally carried by said third means.

11. An electrical interrupter switch comprising:

means for interrupting a circuit path including interrupter drive means operable between open and closed positions;

disconnect drive means including a disconnect drive linkage operable between open and closed positions;

first means responsive to the interrupter drive means and being movable, between first and second position corresponding to said respective open and closed positions of the interrupter drive means;

second means responsive to the position of the disconnect drive linkage and being movable away from a first position when the disconnect drive linkage is moved away from said closed position; and third means for opening the interrupter drive means in response to an input, said third means comprising stored-energy means and a latch operable to provide said input, said first and second means being relatively arranged such that movement of said second means away from said first position is effective to operate said latch only when said first means is in said second position.

12. The electrical interrupter switch of claim 11 wherein said first means includes a first member and said second means includes a second member, said latch including a third member which is movable to release said latch, said second member being effective to impart movement to said third member when said first member is in said second position and said second member is moved away from said first position.

* * * * *

UNITED STATES PATENT AND TRADEMARK OFFICE

CERTIFICATE OF CORRECTION

PATENT NO. : 5,075,521

DATED : December 24, 1991

INVENTOR(S) : Edward J. Rogers, et al

It is certified that error appears in the above-identified patent and that said Letters Patent is hereby corrected as shown below:

Col. 1, lines 8 and 9, delete "U.S. Pat. No. 4,983,492";

Col. 1, line 10, after "1989" insert -- (now U.S. Patent No. 4,983,492) --;

Col. 1, line 40, "operating" should be -- operation --;

Col. 3, line 19, "interrupterswitch" should be -- interrupter switch --;

Col. 4, line 43 "illu" should be -- illustrated --;

Claim 11, col. 6, line 45, after "movable" delete -- , -- (comma).

Signed and Sealed this

Twentieth Day of April, 1993

*Attest:*

MICHAEL K. KIRK

*Attesting Officer*

*Acting Commissioner of Patents and Trademarks*